United States Patent [19]

Gerlach

[11] 3,976,002

[45] Aug. 24, 1976

[54] CAN AND BOTTLE CRUSHER

[75] Inventor: Hans W. Gerlach, Greenfield, Wis.

[73] Assignee: Summit Metal Fabricating, Inc., Cudahy, Wis.

[22] Filed: Feb. 6, 1975

[21] Appl. No.: 547,554

[52] U.S. Cl. ..... 100/215; 100/218; 100/DIG. 2

[51] Int. Cl.[2] ..... B30B 15/30

[58] Field of Search ..... 241/99; 100/DIG. 2, 100/232, 215, 295, 218, 42

[56] References Cited

UNITED STATES PATENTS

| | | | |
|---|---|---|---|
| 2,813,569 | 11/1957 | Nelson | 100/DIG. 2 |
| 3,062,130 | 11/1962 | Huber | 100/DIG. 2 |
| 3,426,673 | 2/1969 | Miner | 100/42 X |
| 3,576,161 | 4/1971 | Wright | 100/232 X |
| 3,889,886 | 6/1975 | Spivey | 241/99 X |

*Primary Examiner*—Billy J. Wilhite
*Attorney, Agent, or Firm*—Wegner, Stellman, McCord, Wiles & Wood

[57] ABSTRACT

A crusher for articles, such as bottles and cans, having a crushing chamber with a top loading opening communicating with a loading chute having baffles for orienting articles entering the crushing chamber and preventing splashback of liquids or kick-back of articles during crushing, a hydraulically-powered piston movable into the crushing chamber to press articles against a fixed end wall of the chamber and a bottom opening in the chamber for gravity drop of crushed articles from the crushing chamber, with an expansion section of the crushing chamber overlying the bottom discharge opening to prevent binding of the crushed articles within the chamber and permit their fall by gravity through the bottom opening.

2 Claims, 4 Drawing Figures

C
31
27
C
30
25
26
23
21
22
70
15
82
71
41
72
83
84
73
C
85
16
18
17
19

CAN AND BOTTLE CRUSHER

BACKGROUND OF THE INVENTION

This invention pertains to an article crusher and more particularly a crusher for bottles and cans which may be either empty, filled or partially filled for crushing the articles prior to disposal.

Many types of compactors or crushing devices are known for compressing material prior to disposal. Those devices that have used hydraulically-operated rams for obtaining high crushing forces have not been particularly suited for crushing of bottles and cans which, on occasion, may be partially or completely filled with liquid and which have been found to be defective and, therefore, not saleable. Soft drink bottlers, brewereies, and can and bottle manufacturers have inspection procedures to determine proper filling of cans or bottles as well as proper construction of a can or bottle. When a defect is discovered in one or a large number of cans or bottles which are either empty or partially filled, it is necessary to dispose of the defective articles which results in bursting thereof and freeing liquid therein for discharge.

SUMMARY

A primary feature of the invention disclosed herein is to provide a crusher for articles, such as bottles and cans which may be either empty or contain liquid, which will simultaneously crush a large number of such articles and wherein loading of articles and discharge of crushed articles is solely by gravity action.

Another feature of the invention is to provide a crusher as defined in the preceding paragraph wherein the gravity loading and discharge action is derived from use of a loading chute disposed above an open upper end of a crushing chamber with baffle means for orienting articles as they fall by gravity into the chamber and with an expansion section of the crushing chamber overlying a bottom discharge opening from the chamber whereby, near the end of the crushing stroke by a powered piston, the crushed articles expand into the expansion section and are free from binding restriction with the walls of the crushing chamber for free fall through this discharge opening.

Other features of the invention relate to the particular construction providing improved results, such as the use of a top plate extending rearwardly from the working face of the piston which functions to move across the lower end of the loading chute to retain articles within the loading chute during the crushing stroke of the piston and the shape of the crushing chamber to assure full and complete compaction of articles therein and to facilitate discharge of liquid from the chamber that may result from crushing of articles having liquid therein.

DESCRIPTION OF THE PREFERRED EMBODIMENT

Figure 1:
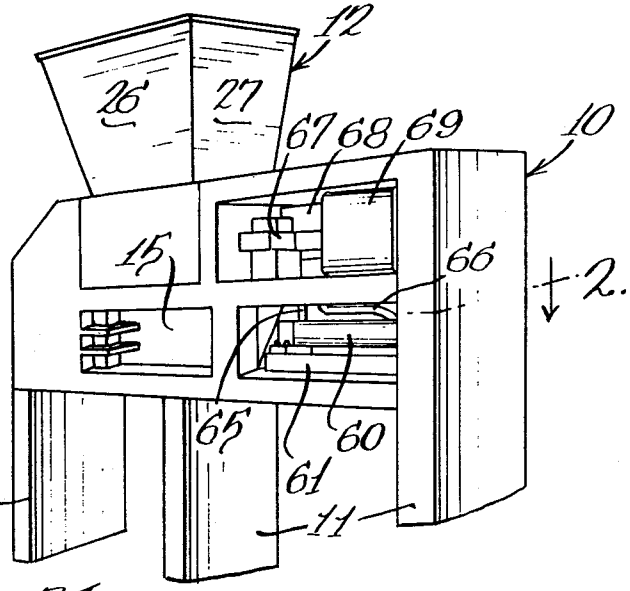
FIG. 1 is a perspective, fragmentary elevational view of the crusher looking toward the rear thereof.

The crusher is shown in FIG. 1 wherein a frame, indicated generally at 10, has a series of floor-engaging legs 11, with the remainder of the frame being constructed generally of structural metal panels suitably secured together as by welding to form a crushing chamber and a mounting for hydraulic components and with a loading chute, indicated generally at 12, superimposed on the frame and overlying a top opening to the crushing chamber. The crushing chamber has a pair of side walls formed by panels 15 and 16 which extend upwardly from a bottom wall having a central trough 17 and oppositely-extending, upwardly-inclined bottom wall sections 18 and 19 connected to the side walls 15 and 16. A fixed end wall 20 for the crushing chamber extends upwardly from a level slightly beneath the level of the trough 17 to coact with a pair of side wall extensions 21 and 22 which slope downwardly and inwardly toward the crushing chamber and with an additionally sloped wall 23 extend to the upper level of the frame 10. The loading chute 12 is removably attached to the frame 10 by suitable means (not shown) and has four downwardly and inwardly sloped walls 25, 26, 27, and 28 extending in directions to form continuations of the walls 20–23.

Baffle means, in the form of a pair of inclined plates 30 and 31, extend inwardly and downwardly from the chute walls 25 and 26, respectively, for orienting a series of articles, as indicated at C, into lengthwise alignment with the trough 17 in the bottom wall of the crushing chamber. These plates are suitably secured, as by welding, to the walls 25 and 26 and are spaced apart a sufficient distance whereby articles of a variety of sizes may pass therebetween in movement into the crushing chamber. The baffles overlap to prevent flushback of liquids and kickback of articles and glass bottle fragments during crushing.

Figure 2:
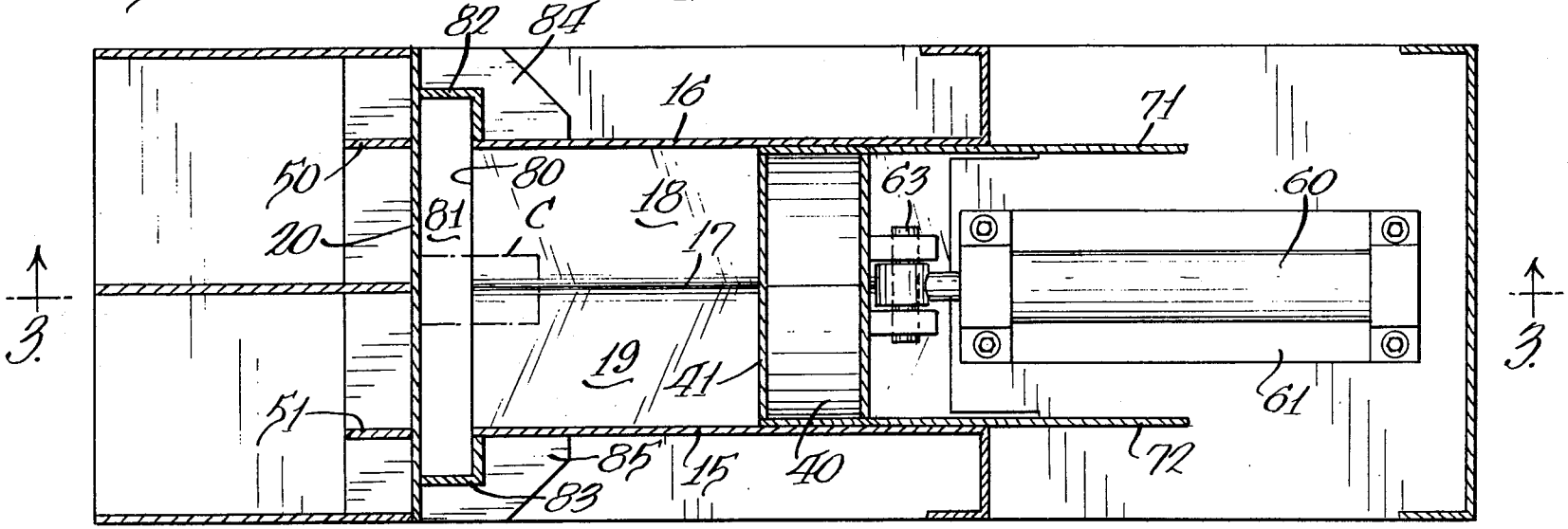
FIG. 2 is a horizontal section of the crusher, taken generally along the line 2—2 in FIG. 1.

A crushing piston 40 has a working face 41 which, in the retracted position of the crushing piston, is generally aligned beneath the wall 23 and forms an additional end wall for the crushing chamber in opposed relation to the fixed end wall 20. This relation is shown in FIG. 2 and in full lines in FIG. 3. Thus, articles may drop by gravity into the crushing chamber and generally in lengthwise alignment whereby as the crushing piston is moved to the left, as viewed in FIG. 3 and in the direction of the arrow 44, forces are applied to the articles C for crushing thereof to a compact size. With the forces being exerted against the fixed end wall 20, there are a series of strengthening ribs 50, 51, and 52 welded thereto and to components of the frame for imparting additional strength.

The piston is moved by means of a hydraulic motor in the form of a cylinder 60 bolted to a structural part 61 of the frame 10 and having a rod 62 connected, at 63, to the rear face of the crushing piston. The cylinder 60 is a double-acting cylinder, with a circuit associated therewith including lines 65 and 66 in circuit with a directional control valve 67. Fluid power is supplied by a pump 68 coupled to an electric motor 69 whereby positioning of the valve 67 controls movement of the crushing piston 40 from the retracted position, shown in FIGS. 2 and 3, to the advanced position shown in broken line in FIG. 3, for crushing of articles followed by retraction of the crushing piston.

Figure 4:
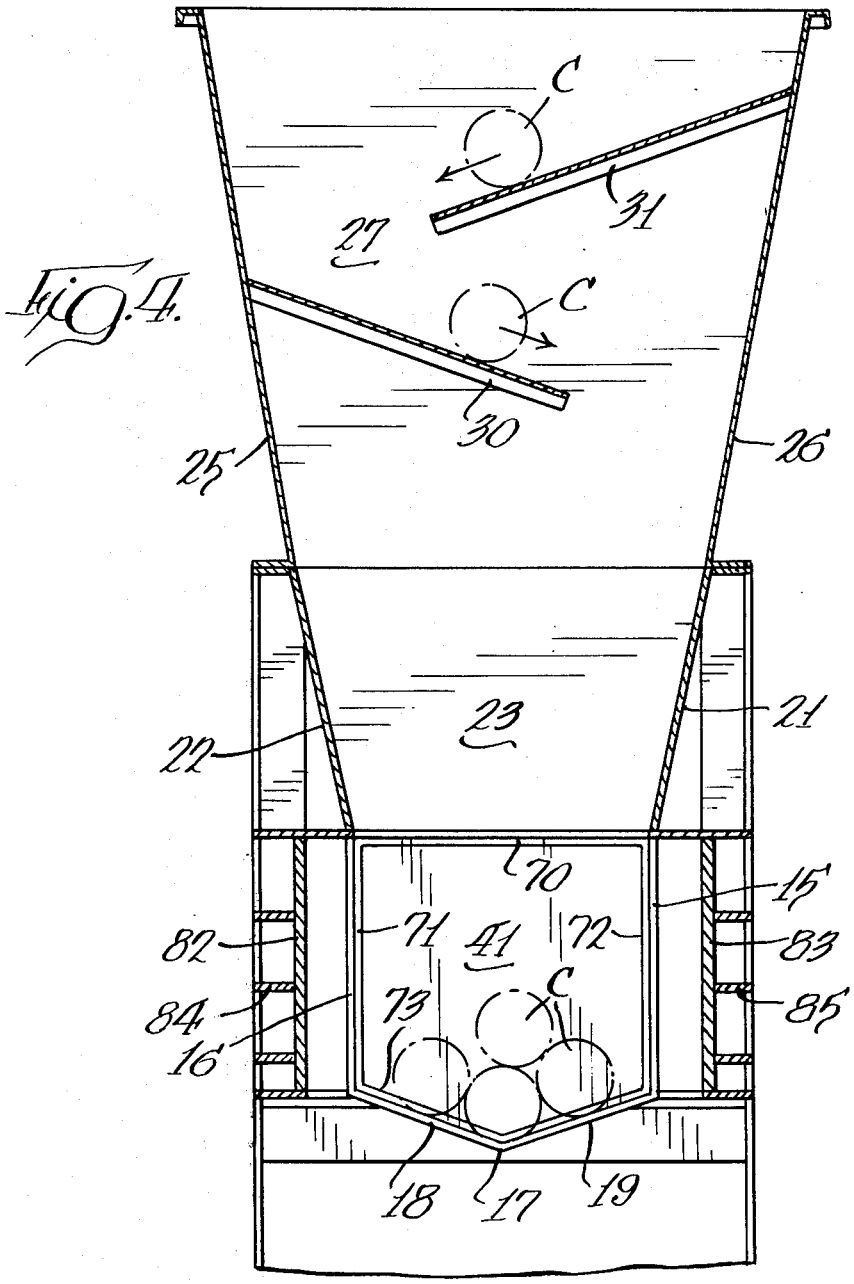
FIG. 4 is a vertical section, taken generally along the line 4—4 in FIG. 3.

The crushing piston 40 has a top plate 70 extending rearwardly from the working face thereof and spanning the top of the crushing chamber whereby as the crushing piston is advanced the top plate 70 functions to close off access of the loading chute 12 to the crushing chamber and prevent entry of articles behind the working face of the piston. Additionally, the crushing piston has a pair of side plates 71 and 72 extending rearwardly from the working face, as well as a bottom plate 73 to slidably fit with the adjacent walls of the crushing chamber and with the bottom plate 73 having generally the same shape as the bottom wall of the crushing chamber, as is shown in FIG. 4.

Figure 3:
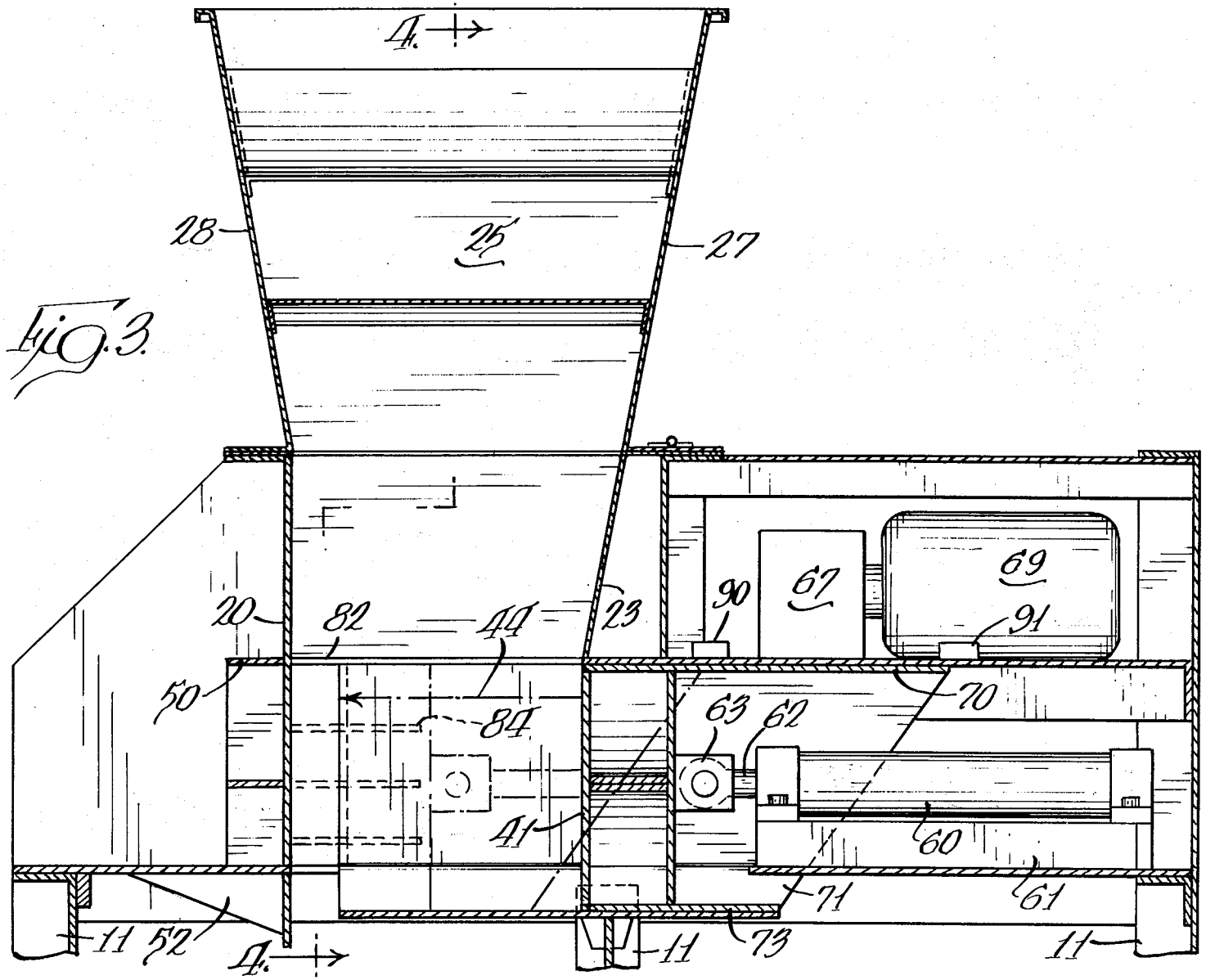
FIG. 3 is a vertical section, taken along the line 3—3 in FIG. 2 with the lower part of the crusher and particularly the supporting legs shown broken away.

As seen particularly in FIGS. 2 and 3, the side walls 15 and 16 of the crushing chamber terminate short of the fixed end wall 20 and the bottom wall has an edge 80 spaced therefrom with the termination of the bottom wall providing a discharge opening 81 for gravity release of crushed articles from the crushing chamber.

In crushing of articles, considerable force is applied thereto which normally would tend to cause the crushed articles to bind the crushing chamber. This problem is overcome and the gravity release of compacted or crushed articles is enhanced by having an expansion section for the crushing chamber adjacent the fixed end wall 20. This is accomplished by the use of a pair of vertically-extending, L-shaped sections 82 and 83 which are secured to the fixed end wall 20 and to the side walls 15 and 16, as shown in FIG. 2, and which effectively increase the space between the side walls of the crushing chamber in an area overlying the discharge opening 81.

A series of vertically-spaced reinforcing ribs 84 and 85 are associated with the L-shaped sections 82 and 83, respectively, and are secured thereto as well as to the side walls 15 and 16 of the crushing chamber and the end wall 20 to rigidify and strengthen the structure.

The crushing piston 40 advances to the broken line position, shown in FIG. 3, generally in alignment with the edge 80 of the bottom wall of the crushing chamber in a crushing operation and the crushed articles, by being moved into the expansion section of the crushing chamber during the final advance of the crushing piston, are not bound therein and are free to drop through the discharge opening 81 immediately upon retraction of the crushing piston. Any liquid involved in the crushing operation, as by crushing of defective filled or partially-filled cans and bottles, is free to move along the bottom wall and along the trough 17 for discharge through the discharge opening 81.

The control of the stroke of the hydraulic motor, and, thus, the advanced and retracted positions of the crushing piston 40, may be obtained by limit switches 90 and 91 positioned for engagement by the top plate 70 extending rearwardly from the working face of the piston, with the control by limit switches of the hydraulic circuit including a directional control valve 67 being generally known in the art.

As shown diagrammatically in FIG. 2, an article C, such as a soft drink or beer can, is positioned for crushing and it will be noted that the discharge opening 81 is not of a size sufficient to permit an uncrushed can to fall through the discharge opening.

With the structure disclosed herin, articles, such as cans and bottles, may fall by gravity through the loading chute 12 and be oriented thereby and into position in the crushing chamber, with the crushing chamber of a size to handle a relatively large number of articles in a single crushing cycle. The crushing piston having the top plate 70 automatically cuts off the supply of articles disposed above the level of the crushing chamber during a crushing cycle and permits reloading of the crushing chamber after the crushing piston leaves its advanced position. In addition to gravity fill of the crushing chamber, the crushed articles may fall by gravity through the discharge opening 81 whereby there is no requirement for orientation of the articles in loading of the crusher or for handling of the crushed articles in unloading the crusher chamber.

I claim:

1. A crusher for articles such as bottles and cans including a crushing chamber with fixed side walls and a fixed end wall, a loading chute above and opening to said chamber, a crushing piston at the level of said chamber and mounted for movement into said chamber toward said end wall, said piston having a working face with a width substantially equal to the space between the chamber side walls and a height substantially equal to the height of said crushing chamber and a rectangular top plate extending rearwardly from the top of said working face for closing off said loading chute as the piston advances to prevent articles falling behind the piston, said chamber having a bottom opening adjacent said chamber end wall for gravity drop of crushed articles, and said fixed side walls being at an increased distance apart adjacent said end wall throughout the entire height of the crushing chamber and above said bottom opening to define an expansion section of the chamber to free the crushed articles for said gravity drop.

2. A crusher as defined in claim 1 wherein said chamber has a bottom wall with said bottom opening, said bottom wall having a centrally disposed trough extending longitudinally thereof with upwardly inclined sections to either side thereof to facilitate orientation of articles in said chamber as they fall from said loading chute, and said loading chute having a plurality of inclined baffle plates with free edges parallel to said centrally disposed trough for orienting articles for lengthwise positioning in said chamber and preventing upward passage of liquid or articles during crushing.

* * * * *